United States Patent [19]

Banfield

[11] Patent Number: 4,884,658

[45] Date of Patent: Dec. 5, 1989

[54] COLLAPSIBLE SAWHORSE

[76] Inventor: William A. Banfield, P.O. Box 13F, Ipava, Ill. 61441

[21] Appl. No.: 261,430

[22] Filed: Oct. 24, 1988

[51] Int. Cl.[4] ..... B27B 21/00; B25H 1/06; F41J 1/10

[52] U.S. Cl. ..... 182/129; 182/155; 182/225; 269/901; 273/407

[58] Field of Search ..... 182/155, 181–186, 182/224, 225, 226, 129; 269/901; 273/407, 410, 127 R

[56] References Cited

U.S. PATENT DOCUMENTS

| | | | |
|---|---|---|---|
| 889,494 | 6/1908 | Van Halder | 182/155 |
| 934,736 | 9/1909 | Koch . | |
| 2,594,464 | 4/1952 | Loucks | 182/155 |
| 2,854,290 | 9/1958 | Steen | 182/181 |
| 3,064,755 | 11/1962 | Illes | 182/155 |
| 4,030,565 | 6/1977 | Chaput . | |
| 4,152,834 | 5/1979 | Stansberry . | |
| 4,278,148 | 7/1981 | Daley | 182/181 |
| 4,298,094 | 11/1981 | Strong . | |
| 4,375,245 | 3/1983 | Schill | 182/182 |
| 4,489,808 | 12/1984 | Voye . | |

*Primary Examiner*—Reinaldo P. Machado
*Attorney, Agent, or Firm*—Bacon & Thomas

[57] ABSTRACT

A collapsible sawhorse including a crossbeam and two pairs of legs connected at opposite ends of the crossbeam for disposition between a load-supporting position and a folded position, wherein each pair of legs is pivotally connected to a support member that is pivotally connected to the crossbeam so that each support member and its pair of legs may collectively pivot between the two positions. Brackets are provided for detachably supporting a projectile target to the crossbeam.

15 Claims, 4 Drawing Sheets

COLLAPSIBLE SAWHORSE

BACKGROUND OF THE INVENTION

1. Field of the Invention

This invention generally involves the field of technology pertaining to load supporting devices. More specifically, the invention relates to an improved sawhorse structure which is capable of being collapsed from a conventional load-supporting position into a folded position for transport or storage.

2. Description of the Prior Art

A typical sawhorse as utilized in the carpentry field is defined by an elongate crossbeam provided with two pairs of outwardly extending legs at its opposite ends for supporting the crossbeam in a raised horizontal position, so that a pair of sawhorses may be disposed in a spaced relationship for supporting a load extending across their crossbeams. A sawhorse of this type is normally constructed from pieces of lumber nailed together and provided with crossbraces between each pair of legs and another brace that extends between the crossbraces under the crossbeam in order to form a sturdy load-supporting structure.

The sawhorse may either be in a preassembled form, or the parts thereof be assembled by the carpenter at the job site. Preassembled sawhorses occupy a significant amount of space when transported or placed in storage. There have been many attempts to provide a sawhorse which may be quickly and easily assembled at the job site and occupy a minimum amount of space for transport and storage purposes. Efforts in this regard have resulted in a preassembled sawhorse that is capable of being unfolded for use and thereafter collapsed into a structure of minimum dimensions. Collapsible sawhorses are basically constructed with each pair of legs being connected to its corresponding end of the crossbeam in such a way that the legs may first pivot toward each other, and thereafter collectively pivot inwardly toward the crossbeam. In the fully collapsed position, the legs and crossbeam are disposed substantially in parallel and thereby define a compact package which is easy to handle and occupies a minimum of space.

In addition to the obvious advantage of its collapsibility, a collapsible sawhorse must most importantly have sufficient structural strength for withstanding its normal load-supporting function while disposed in its unfolded position of use. The support strength of the sawhorse is generally determined by the manner in which the legs are connected to the crossbeam for realizing the aforementioned double pivotal movements. It is known to provide linkages which indirectly connect the legs to the crossbeam, and also to connect the legs directly to the crossbeam.

SUMMARY OF THE INVENTION

It is an object of the invention to provide an improved collapsible sawhorse which is extremely simple in construction and may be quickly and easily unfolded into a load-supporting position or folded into a collapsed position for transport and storage.

It is another object of the invention to provide an improved collapsible sawhorse having a structural configuration which provides a high degree of load-supporting strength for use in carpentry or related fields.

It is a further object of the invention to provide an improved collapsible sawhorse capable of supporting a target for archery practice.

These and other objects of the invention are realized by providing a collapsible sawhorse comprised of an elongate crossbeam provided with two pairs of legs pivotally connected to opposite ends of the crossbeams by a pair of support members. Each support member is pivotally connected to an end of the crossbeam and a pair of legs are pivotally connected to the support member, whereby the legs may pivot about their pivot connections to the support member, with the legs and support member being collectively pivotable towards the crossbeam about the pivot connection between the support member and the crossbeam. Each support member and the crossbeam are provided with corresponding plate sections having edge portions that are disposable in abutting engagement when the corresponding pairs of legs and support member are collectively pivoted outwardly for disposition into the position of use. The crossbeam is further provided with brackets for detachably supporting a target assembly for archery practice.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figures 1, 2:
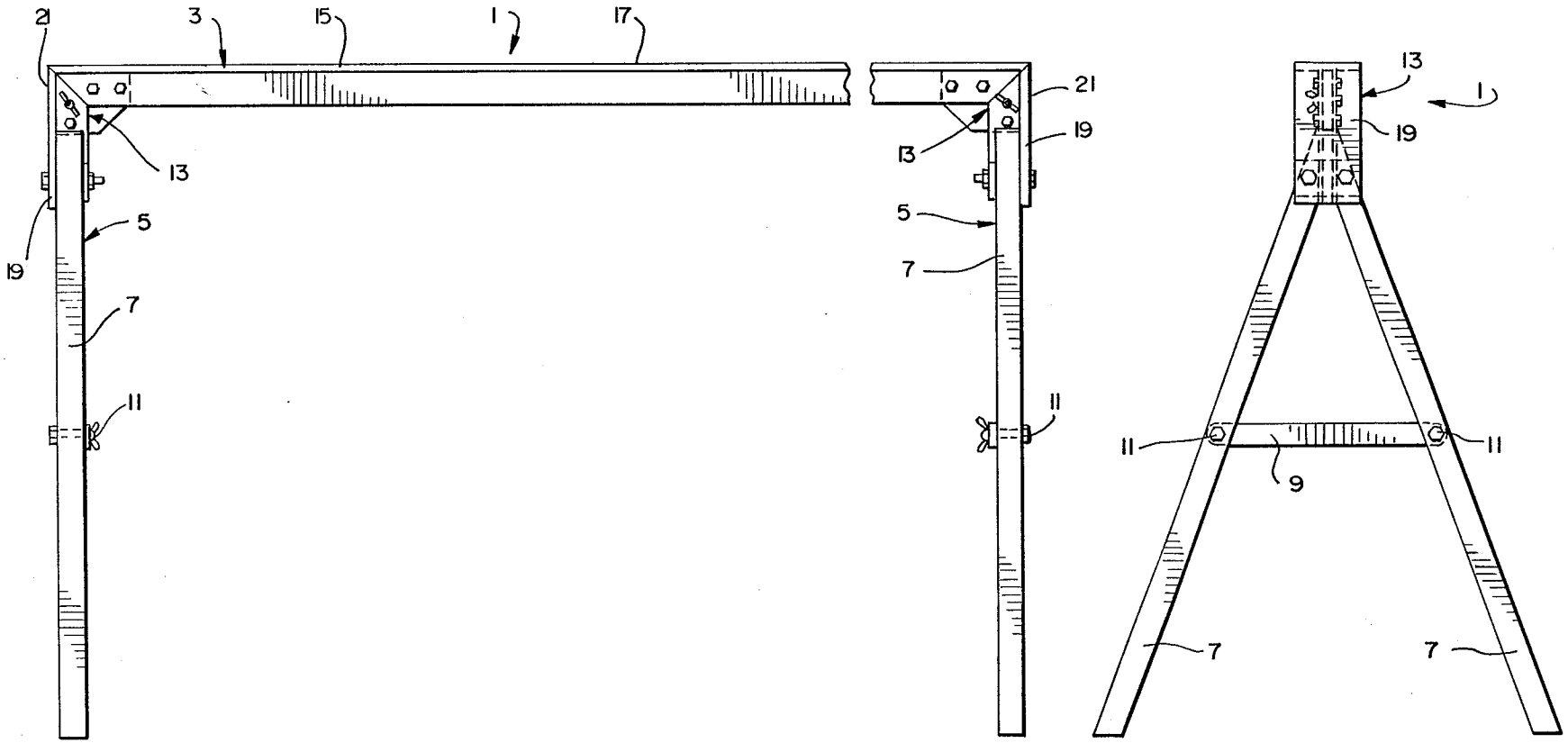
FIG. 1 is front elevational view, shown partly fragmented, of a collapsible sawhorse according to a preferred embodiment of the invention.
FIG. 2 is a side elevational view of the sawhorse shown in FIG. 1.

A collapsible sawhorse 1, according to a preferred embodiment of the invention, shall now be described with initial reference to FIGS. 1 and 2. As shown therein, sawhorse 1 is disposed in an unfolded position of use. In this position, sawhorse 1 is seen to include an elongate crossbeam 3 for supporting a load and a pair of leg assemblies 5 connected at opposite ends of crossbeam 3 for disposing the latter in a raised horizontal position. Each leg assembly 5 includes a pair of elongate legs 7 that are provided with an intermediate brace member 9 for maintaining leg 7 in the spread apart position shown in FIG. 2. Brace member 9 may be in the form of a rigid strap connected at its opposite ends to leg 7 by a pair of appropriate mechanical fasteners 11. It is preferred that one fastener 11 serves to permanently and pivotally secure an end of brace member 9 to a leg 7, while the other fastener 11 permits a quick detachable connection of the other end of member 9 to the remaining leg 7.

As further shown in FIGS. 1 and 2, each leg assembly 5 is pivotally connected to an elongate support member 13 which is, in turn, pivotally connected to an end of crossbeam 3. As also apparent, crossbeam 3 is partially formed by a first longitudinal plate section 15, which preferably extends for the entire length of crossbeam 3 and defines a flat upper surface 17 for supporting a load thereon. Each support member 13 is also partially formed by a second longitudinal plate section 19 which defines a flat side surface 21. The widths of plate section 15 and both plate sections 19 are preferably the same, as depicted in FIGS. 1 and 2.

Figure 3:
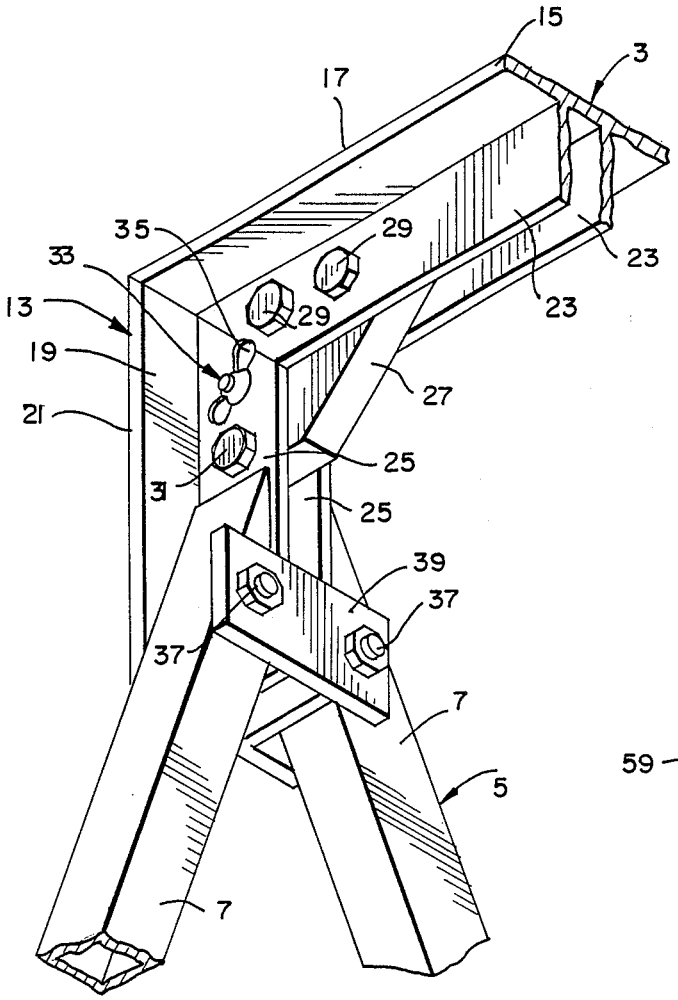
FIG. 3 is a partial perspective view of the sawhorse, particularly showing the manner in which a pair of legs is attached to its corresponding end of the crossbeam.

The manner in which each leg assembly 5 is connected to crossbeam 3 shall now be described with reference to FIG. 3. As shown therein, crossbeam 3 preferably has a T-shaped transverse cross-sectional configuration defined by plate section 15 and a pair of spaced parallel flanges 23. Similarly, each support member 13 also has a T-shaped transverse cross-sectional configuration defined by plate section 19 and a pair of spaced parallel flanges 25. It is preferred that the cross-sectional configurations of crossbeam 3 and each member 13 be exactly the same, and extend uniformly for substantially the entire lengths thereof. A support block 27 is disposed between flanges 23 at each end of crossbeam 3, and secured thereto by one or more appropriate mechanical fasteners 29, such as nut and bolt assemblies. Support member 13 is pivotally secured to block 27 by an appropriate mechanical fastener 31, such as a nut and bolt assembly, which defines a pivot axis about which member 13 may pivot inwardly with respect to crossbeam 3. A detachable locking member 33 is provided to prevent pivoting of support member 13 with respect to crossbeam 3 when sawhorse 1 is in the depicted position of use. Member 33 may be in the form of a bolt or pin extending through aligned passageways formed in block 27 and flanges 25, and secured in this position by a wing nut 35 or other appropriate means.

It shall particularly be noted that the corresponding adjacent edge portions of plate sections 15, 19 and flanges 23, 25 are each inwardly beveled at an angle of forty-five degrees. In this way, the outward pivoting of each support member 13 is automatically terminated when these edge portions are disposed in abutting engagement with each other, as seen in FIG. 3. This also disposes plate sections 15, 19 and flanges 23, 25 in a right angle relationship with each other.

Each leg 7 of assembly 5 is preferably of tubular o construction and has a substantially rectangular-shaped transverse cross-section. As indicated in FIG. 3, corresponding end of each leg 7 is pivotally secured to support member 13 by an appropriate mechanical fastener 37, such as a nut and bolt assembly, with each assembly 37 thereby defining a pivot axis for its corresponding leg 7. Assemblies 37 are secured through aligned passageways provided in plate section 19, legs 7 and a plate 39, the latter being disposed in abutting engagement against the inner edges of flanges 25. Assemblies 37 permit legs 7 to pivot between an outward position of use, as shown in FIG. 3, and an inward folded position wherein legs 7 are disposed in parallel for transport or storage. The degree to which each leg 7 may pivot outwardly is determined by providing the terminal end of leg 7 with a beveled face 41 for engaging flange 25. It is apparent that the degree of outward pivot is established by the angle of face 41.

Figure 4:
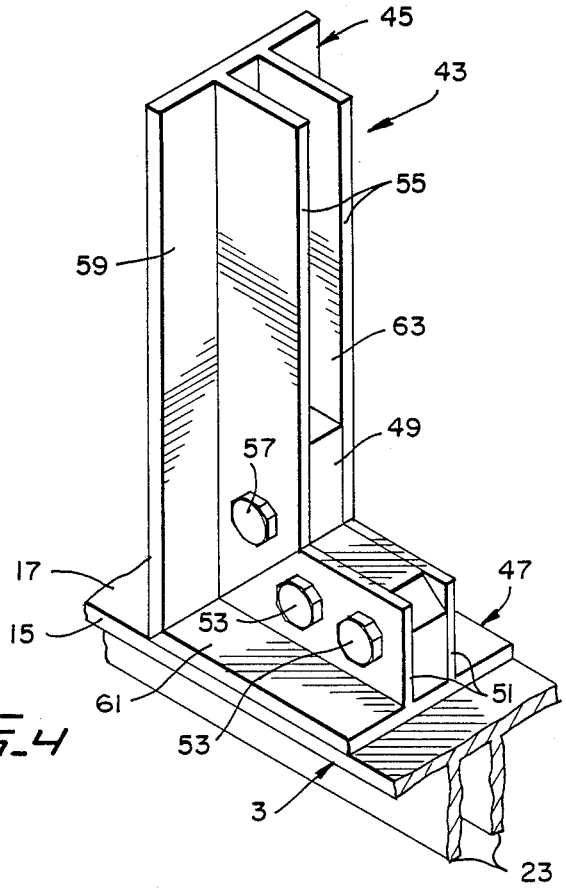
FIG. 4 is a partial perspective view showing a bracket attached to the crossbeam for supporting a target assembly.
Figure 5:
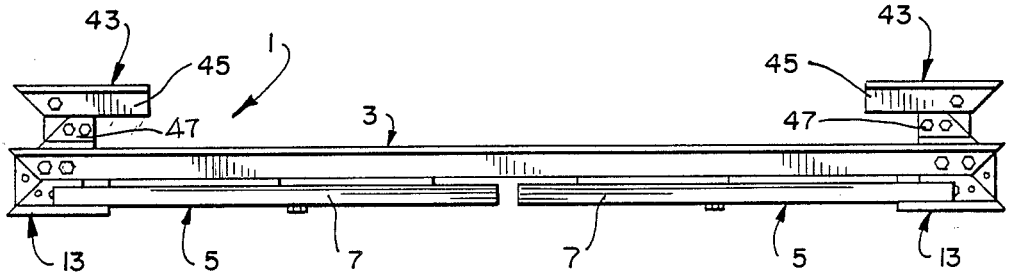
FIG. 5 is a front elevational view showing the sawhorse of FIG. 1 in a fully collapsed position for transport storage and also provided with a pair of brackets on the crossbeam.
Figure 6:
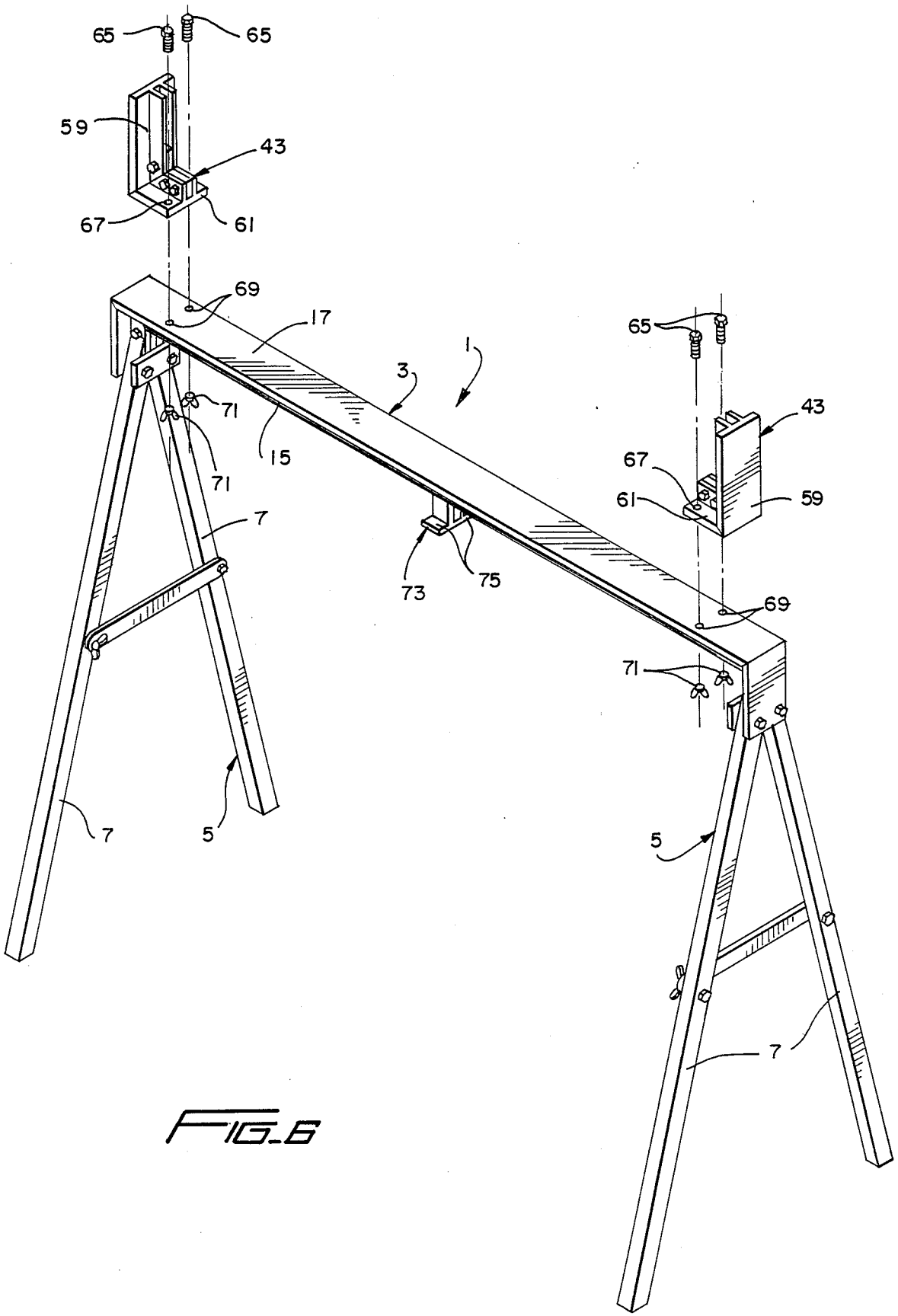
FIG. 6 is a perspective view, partly exploded, showing the sawhorse in its unfolded position of use and depicting a means for attaching the brackets to the crossbeam, the latter further being shown with a retainer on its underside for securing the two pairs of legs in their fully collapsed position.

As shown in FIGS. 4, 5 and 6, sawhorse 1 is also provided with a pair of brackets 43 which may be detachably secured to crossbeam 3 for a purpose to be later described. Each bracket 43 is defined by a pivotal member 45 which is secured to a base member 47 for pivotal movement between an extended position of use, as shown in FIG. 4, and a folded position for transport or storage, as shown in FIG. 5. As also apparent from FIG. 4, it is preferred that members 45 and 47 are each of the same T-shaped transverse cross-sectional configuration as crossbeam 3 and support members 13. The pivotal attachment of member 45 to member 47 is realized through a support block 49 which is attached between a pair of spaced parallel flanges 51 of member 47 by a plurality of mechanical fasteners 53, such as nut and bolt assemblies. Block 49 is also attached between a pair of spaced flanges 55 of member 45 by an appropriate mechanical fastener 57, such as a nut and bolt assembly, with fastener 57 defining a pivot axis for member 45. Members 45 and 47 are provided with plate sections 59 and 61, respectively. Corresponding edge portions of flanges 51, 55 and plate sections 59 and 61 are also provided with forty-five degree bevels to dispose members 45 and 47 in a right angle disposition when bracket 43 is in the position of use shown in FIG. 4. As further noted, in the latter position, flanges 55 of each bracket 43 defines an inwardly directed channel 63 for a purpose to be hereinafter described.

As shown in FIG. 6, a plurality of threaded fasteners 65 may be used for detachably securing each bracket 43 to upper surface 17 of crossbeam 3 by providing aligned apertures 67 and 69 through plate section 61 of bracket 43 and plate section 15 of crossbeam 3, respectively. A plurality of corresponding wing nuts 71 may be used to engage the threaded ends of fasteners 65, thereby permitting quick attachment or detachment of brackets 43 with respect to crossbeam 3. A retainer 73 may be secured to the lower side of crossbeam 3 and includes a pair of outwardly extending flanges 75 for engaging legs 7 when sawhorse 1 is disposed in the fully collapsed position shown in FIG. 5. Flanges 75 prevent the inadvertent outward pivoting of each leg assembly 5 and its associated support member 13 about the pivot axis defined by fastener 31.

Figure 7:
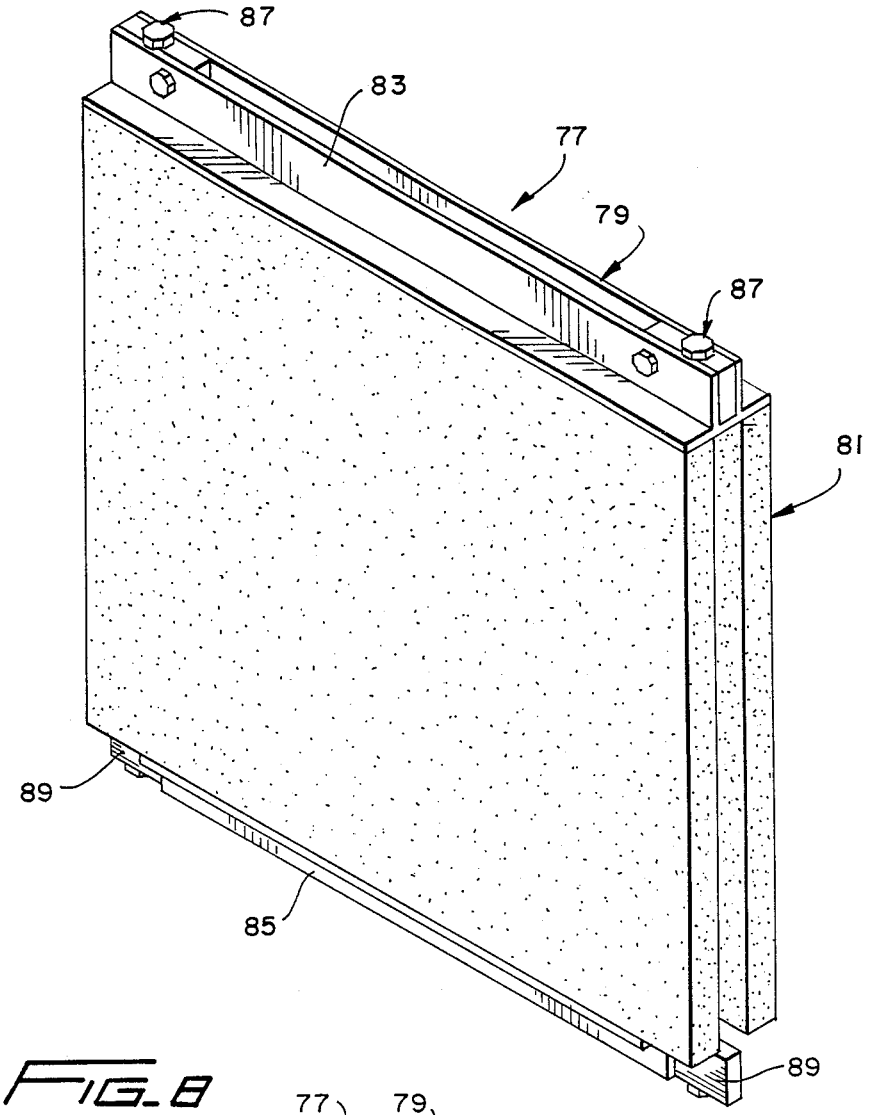
FIG. 7 is a perspective view of a target assembly for detachable engagement with the brackets shown in FIG. 6.
Figure 8:
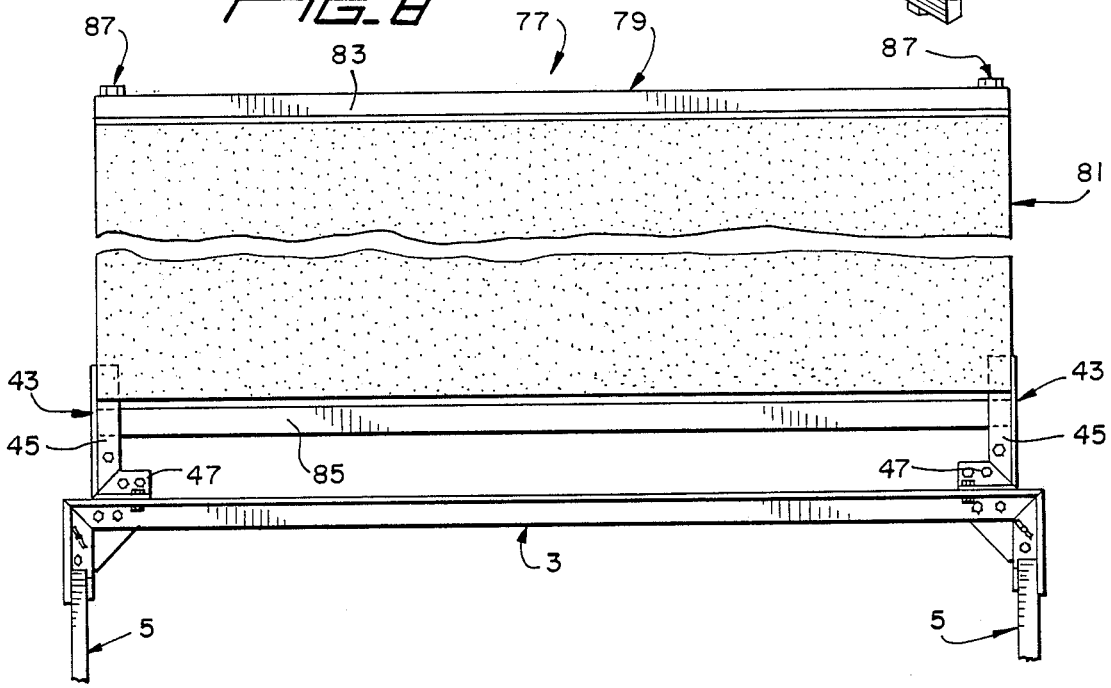
FIG. 8 is a front elevational view partly in section, showing the target assembly of FIG. 7 engaged within the brackets of FIG. 6 and disposed in a position of use on the sawhorse.

The purpose of brackets 43 shall now be described with reference to FIGS. 7 and 8. As seen in FIG. 7, there is provided a target assembly 77 which includes a frame 79 and a planar-shaped member defining a panel 81. Frame 79 may include an upper elongate member 83 and a lower elongate member 85 which secures panel 81 therebetween by a pair of spaced bolt assemblies 87 which may be tightened to compress members 83 and 85 against opposed upper and lower edge portions of panel 81. Members 83 and 85 are each preferably of the same T-shaped transverse cross-sectional configuration as that of crossbeam 3, support members 13 and members 45 and 47 of bracket 43. Lower member 85 is provided with a pair of outwardly extending tabs 89 which are configured and sized for slidable disposition within inwardly directed channels 63 of brackets 43. This is shown in FIG. 8 wherein assembly 77 is in its position of attachment to brackets 43, in which position tabs 89 are disposed in abutting engagement with support blocks 49 of brackets 43.

Panel 81 may be formed from any material deemed suitable for the intended use of assembly 77 as a projectile target for archery or firearm practice. Different materials shall, of course, be utilized for different types of projectiles. Although assembly 77 has been disclosed herein as a target, it is also understood that brackets 43 and assembly 77 may function in any other manner of use wherein it is desired to support a planar-shaped member in a vertical disposition, for example, such as a sign display.

It is preferred that sawhorse 1 be constructed substantially entirely of aluminum alloy which, together with the novel structure of sawhorse 1, provides an extremely lightweight construction having high load supporting capability and strength for the intended uses of the invention as disclosed herein. The collapsible nature of sawhorse 1 and its associated brackets 43 permit the entire assembly to be folded into the very compact package shown in FIG. 5 for transport and storage purposes.

It is to be understood that the form of the invention herein shown and described is to be considered a preferred embodiment thereof, and that various changes in shape, size, material and arrangement of parts may be resorted to by one of ordinary skill in the art, and within the scope of the subjoined claims.

I claim:

1. A collapsible sawhorse of the type including a crossbeam for supporting a load thereon and two pairs of legs pivotally connected at opposite ends of the crossbeam for disposition between a first load-supporting position and a second collapsed position, the improvement comprising:

(a) a stationary support block secured to the underside of the crossbeam at each end thereof;

(b) a support member connected to each support block for pivot movement relative to the support block by a first pivotal connection means;

(c) each pair of legs being connected to a support member by a second pivotal connection means;

(d) the first pivotal connection means permitting each support member and its corresponding pair of legs to collectively pivot inwardly about the first pivotal connection means toward the crossbeam, and the second pivotal connection means permitting the legs to be spread outwardly in the first position and folded together in parallel with each other in the second position;

(e) alignable passageway means formed through each support block and its corresponding support member, the passageway means being aligned and positioned below the underside of the crossbeam when the pairs of legs are disposed in the first load-supporting position; and (f) locking means disposable in the aligned passageway means for maintaining each support member and its corresponding pair of legs in the first load-supporting position.

2. The sawhorse of claim 1 wherein the crossbeam, support members and pairs of legs are formed of aluminum.

3. The sawhorse of claim 1 wherein the crossbeam includes means for retaining the pairs of legs folded together in parallel with the crossbeam in the second position.

4. The collapsible sawhorse of the type including a crossbeam for supporting a load thereon and two pairs of legs pivotally connected at opposite ends of the crossbeam for disposition between a first load-supporting position and a second collapsed position, the improvement comprising:

(a) the crossbeam including a first plate section having a first edge portion at each end thereof;

(b) a pair of support members, each support member being connected to an end of the crossbeam by a first pivotal connection means and including a second plate section having a second edge portion;

(c) the first and second edge portions being disposable in abutting engagement when the support members are in the first load-supporting position;

(d) each pair of legs being connected to a support member by a second pivotal connection means; and (e) the first pivotal connection means permitting each support member and its corresponding pair of legs to collectively pivot inwardly toward the crossbeam, and the second pivotal connection means permitting the legs to be spread outwardly in the first position and folded together in parallel with each other in the second position.

5. The sawhorse of claim 4 further including locking means for maintaining each support member and its corresponding pair of legs in the first position.

6. The sawhorse of claim 4 wherein the first and second edge portions are each provided with an inwardly directed bevel of approximately forty-five degrees to dispose the first and second plate sections at a right angle when the first and second edge portions are in abutting engagement.

7. The sawhorse of claim 1 wherein:

(a) each first plate section includes a pair of first inwardly directed spaced flanges;

(b) each second plate section includes a pair of second inwardly directed spaced flanges; and (c) the first and second flanges being each provided with corresponding flange edge portions disposable in abutting engagement with each other when the support members are in the first position, the flange edge portions having inwardly directed bevels of approximately forty-five degrees to dispose the first and second flanges of right angles when the flange edge portions are in abutting engagement.

8. The sawhorse of claim 7 wherein the crossbeam and the support members each have the same transverse cross-sectional configuration.

9. The sawhorse of claim 8 wherein the transverse cross-sectional configuration is substantially T-shaped.

10. A collapsible sawhorse of the type including a crossbeam for supporting a load thereon and two pairs of legs pivotally connected at opposite ends of the crossbeam for disposition between a first load-supporting position and a second collapsed position, the improvement comprising:

(a) a pair of support members, each support member being connected to an end of the crossbeam by a first pivotal connection means;

(b) each pair of legs being connected to a support member by a second pivotal connection means;

(c) the first pivotal connection means permitting each support member and its corresponding pair of legs to collectively pivot inwardly toward the crossbeam, and the second pivotal connection means permitting the legs to be spread outwardly in the first position and folded together in parallel with each other in the second position;

(d) bracket means attachable to the crossbeam; and (e) a frame detachably engageable with the bracket means for supporting a planar-shaped member in a vertical position above the crossbeam.

11. The sawhorse of claim 10 wherein the bracket means includes a pair of brackets attachable at opposite ends of the crossbeam, each bracket including an inwardly directed channel, and the frame includes a pair of outwardly directed tabs for detachable engagement within the channels.

12. The sawhorse of claim 10 further including a planar-shaped member supported by the frame for absorbing the impact of a projectile.

13. A sawhorse of the type including a crossbeam for supporting a load thereon and two pairs of outwardly extending legs connected at opposite ends of the crossbeam for maintaining the crossbeam in a horizontal load supporting position, the improvement comprising bracket means attachable to the crossbeam and a frame detachably engageable with the bracket means for supporting a planar-shaped member in a vertical disposition above the crossbeam.

14. The sawhorse of claim 13 wherein the bracket means includes a pair of brackets attachable at opposite ends of the crossbeam, each bracket including an inwardly directed channel, and the frame includes a pair of outwardly directed tabs for detachable engagement within the channels.

15. The sawhorse of claim 13 further including a planar-shaped member supported by the frame for absorbing the impact of a projectile.

* * * * *